US008887319B2

(12) United States Patent
Whiteside

(10) Patent No.: US 8,887,319 B2
(45) Date of Patent: Nov. 18, 2014

(54) ADJUSTABLE FIXTURE SUPPORT CARRIER FOR OFF-THE-FLOOR PLUMBING FIXTURES

(71) Applicant: MIFAB, Inc., Chicago, IL (US)

(72) Inventor: Michael James Whiteside, Chicago, IL (US)

(73) Assignee: MIFAB, Inc., Chicago, IL (US)

( * ) Notice: Subject to any disclaimer, the term of this patent is extended or adjusted under 35 U.S.C. 154(b) by 205 days.

(21) Appl. No.: 13/745,212

(22) Filed: Jan. 18, 2013

(65) Prior Publication Data

US 2013/0205494 A1 Aug. 15, 2013

Related U.S. Application Data

(60) Provisional application No. 61/587,777, filed on Jan. 18, 2012.

(51) Int. Cl.
*E03D 11/00* (2006.01)
*E03D 11/14* (2006.01)

(52) U.S. Cl.
CPC ..... *E03D 11/143* (2013.01)
USPC ..... 4/252.3; 4/252.2

(58) Field of Classification Search
USPC ..... 4/695, 252.1–252.3; 285/337, 374
See application file for complete search history.

(56) References Cited

U.S. PATENT DOCUMENTS

| | | | | |
|---|---|---|---|---|
| 3,686,695 | A * | 8/1972 | Mielback et al. | 4/252.3 |
| 8,141,177 | B1 * | 3/2012 | Majocka et al. | 4/252.3 |
| 2004/0133969 | A1 * | 7/2004 | Akin | 4/252.2 |

* cited by examiner

*Primary Examiner* — Tuan N Nguyen
(74) *Attorney, Agent, or Firm* — Phillips Lytle LLP; David L. Principe

(57) ABSTRACT

A fixture support carrier, for mounting a plumbing fixture above the floor, that can be adjusted in either direction by means of interchangeable studs and plastic nipples.

12 Claims, 3 Drawing Sheets

ADJUSTABLE FIXTURE SUPPORT CARRIER FOR OFF-THE-FLOOR PLUMBING FIXTURES

CROSS-REFERENCE TO RELATED APPLICATION

The present application claims priority benefit of U.S. Provisional Patent Application No. 61/587,777 filed on Jan. 18, 2012, entitled "Adjustable Fixture Support Carrier for Off-the-floor Plumbing Fixtures, which is incorporated herein by reference.

FIELD OF THE INVENTION

The invention relates to the field of plumbing, and more particularly to a device for aiding the installation of off-the-floor plumbing fixtures.

BACKGROUND OF INVENTION

Off-the-floor plumbing fixtures are easily the most widely used plumbing fixtures in commercial building today. As the name implies, no part of the fixture touches the floor of the installation. The fixture is mounted to steel studs protruding through the wall from a carrier support in the pipe chase. The carrier support is anchored to the chase floor and receives the fixture load. The advantages of off-the-floor fixtures, as opposed to floor mounted fixtures, are numerous and include improvements in installation, maintenance, sanitation and aesthetics.

Installation of these fixtures typically includes: roughing in the fixture support carrier; anchoring the legs to the floor of the building, and installing the entire carrier assembly including the toilet and finishing wall tile or drywall.

After all of these steps, a plumbing inspector measures the distance from the centerline of the toilet to the outside wall to determine if the installation is in compliance with the requirements of the Americans with Disabilities Act ("ADA"). If the inspector determines that the toilet is too far away or too close to the wall relative to the requirements of the ADA, the contractor may have no choice but to remove the toilet, tear open the finished wall and remove the fixture support carrier so that it can be re-installed a short distance to the left or the right to comply with the strict requirements of the ADA. Accordingly, there is a need for an adjustable fixture support carrier that provides for adjustment to the left or right without moving the legs of the carrier.

SUMMARY OF INVENTION

The present invention meets the above-described need by providing a fixture support carrier that can be adjusted in either direction by means of interchangeable studs and plastic nipples.

BRIEF DESCRIPTION OF THE DRAWINGS

The invention is illustrated in the drawings in which like reference characters designate the same or similar parts throughout the figures of which.

DETAILED DESCRIPTION OF THE INVENTION

Figure 1:
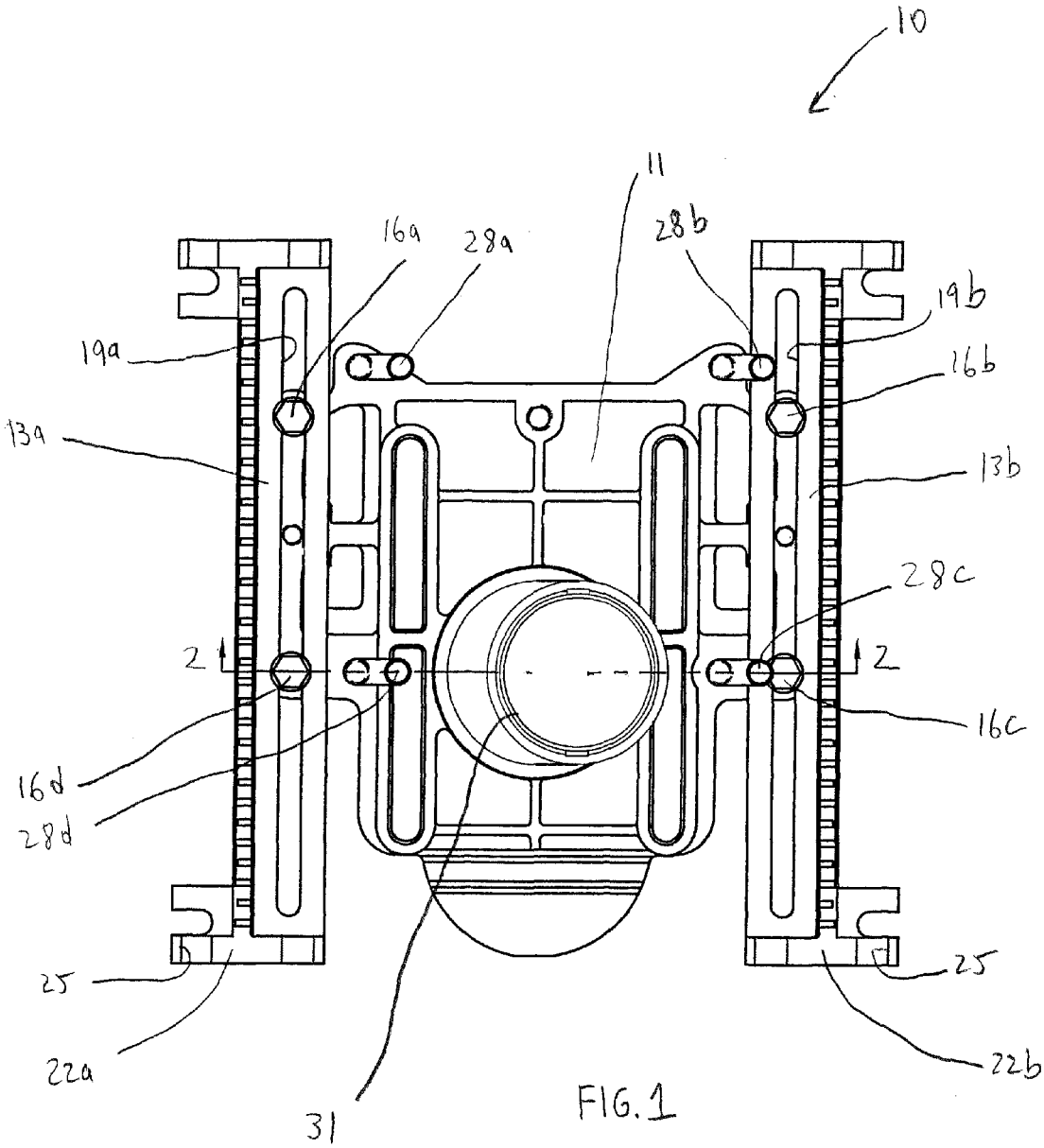
FIG. 1 is a front elevational view of a first embodiment of the fixture support carrier of the present invention.

Turning to FIG. 1, a fixture support carrier 10 includes a carrier faceplate 11 that is supported between two structural feet 13*a*, 13*b*. The sides of the faceplate 11 mount inside vertical grooves 14*a*, 14*b* (FIG. 2) formed in the structural feet 13*a*, 13*b*. The position of the faceplate 11 may be adjusted vertically by means of bolts 16*a-d* that are disposed in vertical slots 19*a*, 19*b* that are formed in the structural feet 13*a*, 13*b*. An anchor foot 22*a*, 22*b* is disposed at the bottom of each of the structural feet 13*a*, 13*b* and has openings 25 for receiving fasteners for attachment to the floor or support surface.

The fixture support carrier 10 includes four threaded studs 28*a-d* and a plastic nipple 31. The nipple 31 may be, for example, four inches in diameter and constructed of ABS. The toilet 59 (FIG. 3) is mounted on the four threaded studs 28*a-d* and the nipple 31 connects to the outlet of the toilet 59. The threaded studs 28*a-d* and the nipple 31 are removably attached to the faceplate 11 as will be described in greater detail below.

Figure 2:
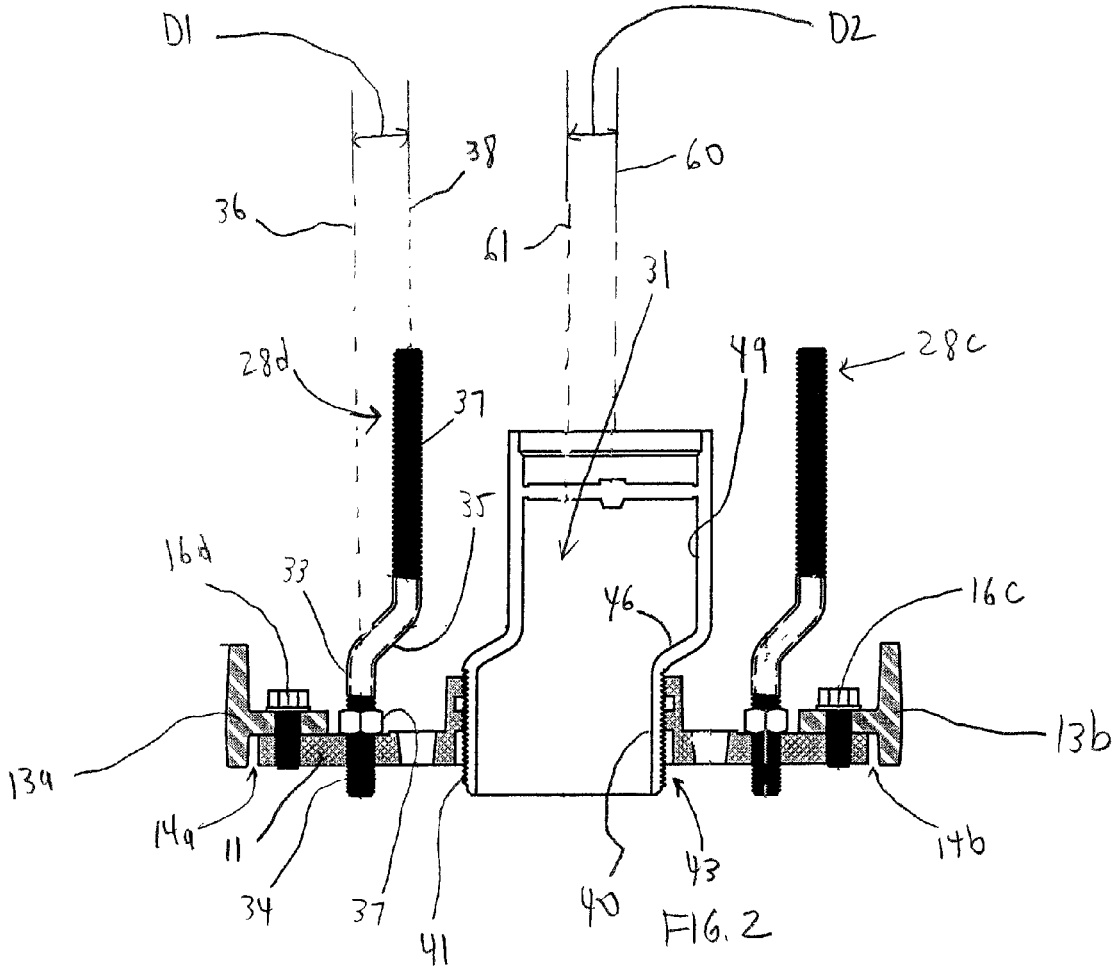
FIG. 2 is a cross-sectional view taken along lines 2-2 of FIG. 1; and, FIG. 3 is a side elevational cutaway view of an off-the-floor plumbing fixture of the present invention.
Figure 3:
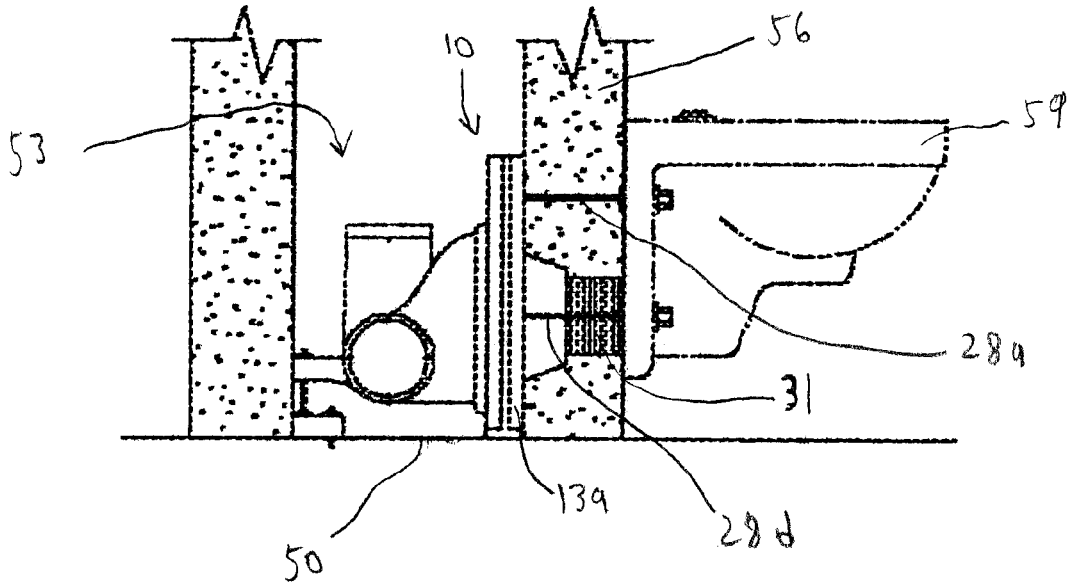

Turning to FIG. 2, the threaded studs 28*c*, 28*d* are shown in greater detail. Stud 28*d* has a first section 33 with a threaded portion 34 that engages with the faceplate 11 to attach the stud 28*d* to the faceplate 11. A nut 37 secures the stud 28*d* to the faceplate 11. The first section 33 is substantially straight and is disposed substantially perpendicular to the faceplate 11. The first section 33 extends to a second section 35. The second section 35 is disposed at an angle relative to the first section 33 and extends to a third section 37. The third section 37 is an elongate, threaded rod for mounting the toilet 59 (FIG. 3). The angled second section 35 disposed between the first section 33 and the third section 37 provides an offset of D1 that is the distance between the centerline 36 of the first section 33 and the centerline 38 of the third section 37. This offset depends on the length of the second section 35 and the angle of the second section 35 relative to the first section 33. The threaded stud 28*d* can be manufactured such that the offset is equal to one-half inch, three-quarters of an inch or one inch. The threaded stud 28*d* could also be designed for other offset dimensions as will be evident to those of ordinary skill in the art based on this disclosure. Also, the stud 28*d* can be arranged in the faceplate 11 such that the offset is generated in either direction. For example, rotation of the stud 28*d* by approximately one-hundred eighty degrees from the orientation shown in FIG. 2, would cause an offset to the left with respect to the orientation of FIG. 2. As shown the stud 28*c* is formed in the same manner and can be manufactured for different offsets and can be rotated to provide an offset in the opposite direction.

The nipple 31 has a first section 40 that has external threads 41 for engaging with an opening 43 in the faceplate 11. The first section 40 is substantially straight and is disposed substantially perpendicular to the faceplate 11 when the nipple 31 is attached to the faceplate 11. The first section 40 extends to a second section 46 that is disposed at an angle to the first section 40. The second section 46 extends to a third section 49 having substantially straight walls. The angle of the second section 46 causes the centerline 60 of the third section 49 to be offset from the centerline 61 of the first section 40 by a distance D2. The nipple 31 may be designed such that the offset is one-half inch, three-quarters of an inch or one inch or other dimensions as will be evident to those of ordinary skill in the art based on this disclosure. Also, rotation of the nipple 31 by approximately one-hundred eighty degrees will cause an offset in the opposite direction (to the left with respect to the orientation of FIG. 2).

Turning to FIG. 3, the fixture support carrier 10 is installed such that the structural feet 13*a, b* are attached to the floor 50 and disposed within the pipe chase 53. The threaded studs 28*a-d* on the fixture carrier 10 extend through the wall 56 to support the toilet 59 above the floor 50. In the standard installation, the threaded studs and nipple may be straight and not have any angled section. However, if the position of the toilet 59 needs to be adjusted after the fixture support carrier 10 has been installed, the present invention provides for adjustments "on the fly" without having to detach the structural feet 13*a*, from the floor 50. The position of the toilet 59 can be adjusted by simply removing the threaded studs and the nipple from the face plate 11 and replacing them with studs 28*a-d* and nipple 31 having an offset as shown in FIG. 2. The amount of the offset will vary depending on the specific geometry of the studs and nipple as described herein and typical standard offsets may be one-half inch, three-quarters of an inch or one inch. Also, depending on the rotation and positioning of the studs 28*a-d* and nipple 31 within the faceplate 11, the offset may be generated in either direction as needed.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A fixture support carrier for mounting a plumbing fixture through a wall, the fixture support carrier comprising:

a support structure;

a faceplate adjustably mounted to the support structure;

a plurality of mounting studs for mounting the plumbing fixture, the mounting studs supported by the faceplate, the mounting studs having a first section extending to a first end and having a second section extending to a second end, the second end disposed opposite from the first end, the central longitudinal axis of the second section disposed in spaced apart, substantially parallel relation to the central longitudinal axis of the first section; and, a nipple supported by the faceplate, the nipple having a first section extending to a first end and having a second section extending to a second end, the central longitudinal axis of the second section disposed in spaced apart, substantially parallel relation to the central longitudinal axis of the first section.

2. The fixture support carrier of claim 1, wherein the mounting studs are mounted to the faceplate such that the studs can be rotated from a first position to a second position.

3. The fixture support carrier of claim 1, wherein the nipple is mounted to the faceplate such that the nipple can be rotated from a first position to a second position.

4. The fixture support carrier of claim 1, wherein the support structure comprises a pair of structural feet.

5. The fixture support carrier of claim 4, wherein the structural feet have slots defined therein.

6. The fixture support carrier of claim 5, wherein the faceplate is adjustably mounted to the structural feet by means of bolts received in the slots.

7. A fixture support carrier for mounting a plumbing fixture above a support surface and through a wall, the fixture support carrier comprising:

a faceplate having a central opening, the faceplate supported from the support surface;

a plurality of mounting studs for mounting the plumbing fixture, the mounting studs mounted to the faceplate such that the studs can be rotated from a first position to a second position, the mounting studs having a first section extending to a first end and having a second section extending to a second end, the second end disposed opposite from the first end, the central longitudinal axis of the second section disposed in spaced apart, substantially parallel relation to the central longitudinal axis of the first section;

a nipple mounted in the central opening in the faceplate such that the nipple can be rotated from a first position to a second position, the nipple having a first section extending to a first end and having a second section extending to a second end, the central longitudinal axis of the second section disposed in spaced apart, substantially parallel relation to the central longitudinal axis of the first section;

wherein rotation of the nipple and the mounting studs from the first position to the second position provides for lateral movement of the plumbing fixture.

8. The fixture support carrier of claim 7, wherein the faceplate is supported by structural feet having slots defined therein.

9. The fixture support carrier of claim 8, wherein the faceplate is adjustably mounted to the structural feet by means of bolts received in the slots.

10. A system for installing a plumbing fixture on a wall, the wall being supported by a support surface and having a pipe chase located behind it, the system comprising:

a pair of structural feet supported by the support surface inside the pipe chase on the side of the wall opposite from the plumbing fixture;

a faceplate having a first end, a second end and a central opening, the first and second ends of the faceplate adjustably mounted to the structural feet;

a plurality of mounting studs for mounting the plumbing fixture, the mounting studs mounted to the faceplate such that the studs can be rotated from a first position to a second position, the mounting studs having a first section extending to a first end and having a second section extending to a second end, the second end disposed opposite from the first end, the central longitudinal axis of the second section disposed in spaced apart, substantially parallel relation to the central longitudinal axis of the first section, the mounting studs extending through openings in the wall to support the plumbing fixture on a side of the wall opposite from the pipe chase;

a nipple mounted to the faceplate such that the nipple can be rotated from a first position to a second position, the nipple having a first section extending to a first end and having a second section extending to a second end, the central longitudinal axis of the second section disposed in spaced apart, substantially parallel relation to the central longitudinal axis of the first section, the nipple extending into an opening in the wall to connect with the plumbing fixture;

wherein the rotation of the nipple and the mounting studs from a first position to a second position provides for lateral movement of the plumbing fixture.

11. The system of claim 10, wherein the structural feet have slots defined therein.

12. The system of claim 11, wherein the faceplate is adjustably mounted to the structural feet by means of bolts received in the slots.

* * * * *